US005946964A

United States Patent [19]

Snyder et al.

[11] Patent Number: 5,946,964

[45] Date of Patent: Sep. 7, 1999

[54] REDRAW SLEEVE FOR CAN BODY MAKING STATION

[75] Inventors: Walter Snyder, Arlington, Tex.; Gregory Giffhorn, Elk Grove, Ill.

[73] Assignee: American National Can Company, Chicago, Ill.

[21] Appl. No.: 09/053,467

[22] Filed: Apr. 1, 1998

[51] Int. Cl.[6] ..... B21D 22/28

[52] U.S. Cl. ..... 72/349

[58] Field of Search ..... 72/349, 350

[56] References Cited

U.S. PATENT DOCUMENTS

| | | | |
|---|---|---|---|
| 3,664,172 | 5/1972 | Cvacho | 72/350 |
| 3,704,619 | 12/1972 | Paramonoff | 72/349 |
| 3,735,629 | 5/1973 | Paramonoff . | |
| 3,789,649 | 2/1974 | Clowes | 72/350 |
| 4,414,836 | 11/1983 | Saunders . | |
| 4,425,778 | 1/1984 | Franek et al. | 72/349 |
| 4,502,313 | 3/1985 | Phalin et al. . | |
| 4,534,201 | 8/1985 | La Rosa et al. . | |
| 4,852,377 | 8/1989 | Mikas et al. . | |
| 4,962,659 | 10/1990 | Imazu et al. | 72/349 |
| 5,014,536 | 5/1991 | Saunders . | |
| 5,263,354 | 11/1993 | Saunders . | |
| 5,347,839 | 9/1994 | Saunders . | |
| 5,394,727 | 3/1995 | Diekoff et al. . | |
| 5,487,295 | 1/1996 | Diekoff et al. . | |
| 5,522,248 | 6/1996 | Diekoff et al. . | |
| 5,544,517 | 8/1996 | Shimizu . | |
| 5,590,558 | 1/1997 | Saunders et al. . | |
| 5,605,248 | 2/1997 | Jentzsch . | |
| 5,691,582 | 11/1997 | Lucas et al. . | |
| 5,775,160 | 7/1998 | Fleischer et al. | 72/349 |

*Primary Examiner*—Lowell A. Larson
*Attorney, Agent, or Firm*—McDonnell Boehnen Hulbert & Berghoff

[57] ABSTRACT

A redraw die for a can body maker incorporates an undercut sidewall, a grooved face and a reduced radius at the intersection between the grooved face and the sidewall. The undercut side wall is positioned proximate to the grooved face so as to permit a cup positioned over the redraw die to flex into an ovoid shape without pinching or binding against the side of the redraw sleeve. These features help prevent the formation of wrinkles when the cup is drawn and ironed in the body maker.

16 Claims, 3 Drawing Sheets

REDRAW SLEEVE FOR CAN BODY MAKING STATION

BACKGROUND OF THE INVENTION

A. Field of the Invention

This invention relates generally to the subject of equipment used in manufacturing drawn and ironed cans, for example, aluminum beverage cans. More particularly, the invention relates to improvements in a redraw sleeve (sometimes referred to as a cup holder) that is used in a body maker or can forming station. The redraw sleeve has several novel features that help prevent wrinkles from forming in the bottom profile of the can as the redrawn cup is drawn and ironed in the body maker.

B. Description of Related Art

It is well known to draw and iron a sheet metal blank to make a thin-walled can body for packaging beverages, such as beer, fruit juice or carbonated beverages. In a typical manufacturing method for making a drawn and ironed can body, a circular disk or blank is cut from a sheet of light gauge metal (such as aluminum). The blank is then drawn into a shallow cup using conventional cup forming punch and die equipment.

The cup is then transferred to a body maker or can forming station. In the body maker, the cup is fed, e.g., by gravity, into the station and positioned over the end portion of a redraw sleeve such that the redraw sleeve fills the interior of the cup. The body maker draws and irons the side walls of the cup to approximately the desired height and forms dome or other features on the bottom of the can. In particular, a conventional body maker includes a punch adapted to move longitudinally within the interior of the redraw sleeve and force the cup through the redraw die and then through co-axially aligned ironing rings. As the punch forces the cup through the ironing rings, the side wall of the can is thinned. At the end of the punch travel, a bottom forming die cooperates with the head of the punch to produce a profile (typically a dome or similar structure) in the bottom wall of the can body.

As the above process is widely used in the aluminum beverage can industry, and therefore familiar to persons of ordinary skill in the art, it will not be described further herein. The general reader is directed to U.S. Pat. No. 4,852,377 and assigned to American National Can Co., the assignee of the present invention, and U.S. Pat. No. 3,735,629 for further details. Other representative patents relating to the same subject matter include U.S. Pat. No. 5,394,727 to Diekoff, U.S. Pat. No. 5,014,536 to Saunders, and U.S. Pat. No. 4,414,836 to Saunders. The above patents are incorporated by reference herein.

After formation of the can by the body maker, the top edge of the can is typically trimmed. The can is transferred to a necking station, where neck and flange features are formed on the upper region of the can. Necking stations are also well known in the art and the reader is directed to U.S. Pat. No. 4,774,839 to Caleffi et al. for a description of a representative necking station.

The present inventors have discovered that improvements to the form and shape of the redraw sleeve can significantly reduce the occurrence of wrinkle formation in the can body as the can is drawn and ironed. Prevention of wrinkles is significant, in that it permits the can forming line to work more efficiently and allows for the use of less material in the cans, reducing the cost of the can.

In particular, it has been noticed that when the cup is placed over the redraw sleeve and subsequently forced into the ironing rings by the punch, the cup side wall frequently tends to become distorted to form an oval shape in cross-section, instead of remaining substantially circular. This results in a pinching of the cup sidewall against the side portion of the redraw sleeve at opposite sides of the redraw sleeve. This phenomenon occurs due to the fact that the cup material possesses a grain or predetermined orientation, wherein the cup tends to flex or bend more easily in one direction (i.e., with the grain), and less easily in the opposite direction. The portions of the cup side wall with the grain tend to become bowed outwardly away from the redraw sleeve, whereas the portion of the cup side wall against the grain tend to become pinched against the side portion of the redraw sleeve. This pinching effect causes more drag between the walls of the cup and the redraw sleeve, resulting in uneven draw and occasional formation of wrinkles in the bottom profile of the redraw cup.

Cups are introduced into the body making station in a manner such that it is either impossible, or prohibitively expensive, to know in advance the direction of the grain of the cup and take corrective action to make the cup remain in an undistorted condition when it is placed over the redraw sleeve. The present inventors have designed an undercut feature in the redraw sleeve which will prevent this pinching or binding between the side walls of the can and the redraw sleeve, regardless of the orientation of the grain in the cup. The result is that the occurrence in wrinkling in the bottom of the redraw cup is reduced.

The present inventors have also discovered that the drawing and ironing process can be further improved by providing features in the redraw sleeve that promote the flow of metal between the closed end of the cup and the side walls of the cup during the drawing and ironing process. In particular, during the drawing and ironing process, the thickness of the closed end of the cup is reduced as metal flows between the face of the redraw sleeve and the redraw die, and into the side walls of the can. In accordance with another aspect of the invention, groove features in the face of the redraw sleeve (or other equivalent features to reduce the surface area thereof) improve the flow of metal around the rim and peripheral edge of the redraw sleeve, resulting in a reduction in the occurrence in wrinkles. A reduced outside radius on the face of the redraw sleeve causes the metal to be held tightly across the face of the punch nose, also resulting in a reduction in the occurrence of bottom wrinkling.

SUMMARY OF THE INVENTION

Several improvement are provided for a redraw sleeve for use in a can body maker. The redraw sleeve comprises a cylindrical body having an open interior for receiving the redraw punch, a cylindrical wall, and a peripheral end wall or face portion for receiving thereover a cup having a side wall of height H to be drawn and ironed into a can in the can body maker.

One of the improvements is providing an undercut feature on the cylindrical wall of the redraw sleeve in the working portion of the redraw sleeve, i.e., closely proximate to the peripheral end wall or face. The undercut feature extends around the periphery of the cylindrical wall. The radius of the cylindrical wall between the undercut feature and the peripheral end wall, designated R1 herein, is greater than the radius R2 of the cylindrical wall below the undercut feature, i.e., between the undercut feature and the opposite end portion of the redraw sleeve.

In particular, the undercut feature is located on the cylindrical wall of the redraw sleeve close to the face of the redraw sleeve, and less than the height of the cup. This location of the undercut feature results in the reduced radius R2 of the cylindrical wall below the undercut feature. The undercut provides a circular gap between the redraw sleeve and the cup, permitting the side wall of the cup to flex to form an ovoid shape, due to grain properties in the cup, without substantial binding between the side wall of the cup and the cylindrical wall of the redraw sleeve during drawing and ironing of the cup.

A second improvement to the redraw sleeve comprises forming one or more groove and concentric ridge features in the peripheral end wall or face of the redraw sleeve. When the redraw sleeve abuts against the redraw die during formation of the can body, the groove features help promote the flow of metal from the closed end of the cup around the peripheral end wall and into the side wall of the cup. The main function of the grooves is to reduce the surface area of the peripheral end wall or face of the redraw sleeve. Accordingly, other possible designs may be chosen. For example, the grooves may be continuous concentric grooves, or discontinuous arcuate segments, or other wise.

A further improvement to the redraw sleeve is also provided by reducing the radius of curvature of the corner of the peripheral end wall where it intersects the peripheral surface of the cylindrical wall of the redraw sleeve. In particular, whereas prior art redraw sleeves typically used a radius of about 0.065 to 0.075 inches for this corner, we have discovered that by reducing this radius to between 0.050 and 0.060 inches, this holds the metal tighter across the draw punch nose face.

Each of the above improvements, practiced alone, has been demonstrated to reduce the occurrence of wrinkles in the can body. The advantages in reduction of wrinkles provided by the above improvements are, in one sense, independent of each other. Thus, the invention can be practiced by adopting just one of the improvements, two of the improvements (e.g., the undercut feature and grooved face), or, more preferably, all three improvements.

These, and other advantages, features and improvements of the invention will be more apparent from the following detailed description of the invention.

BRIEF DESCRIPTION OF THE DRAWINGS

Presently preferred embodiments of the invention are described below in conjunction with the drawings, in which like reference numerals refer to like elements in the various views, and in which.

DETAILED DESCRIPTION OF THE PREFERRED EMBODIMENTS OF THE INVENTION

Figure 1:
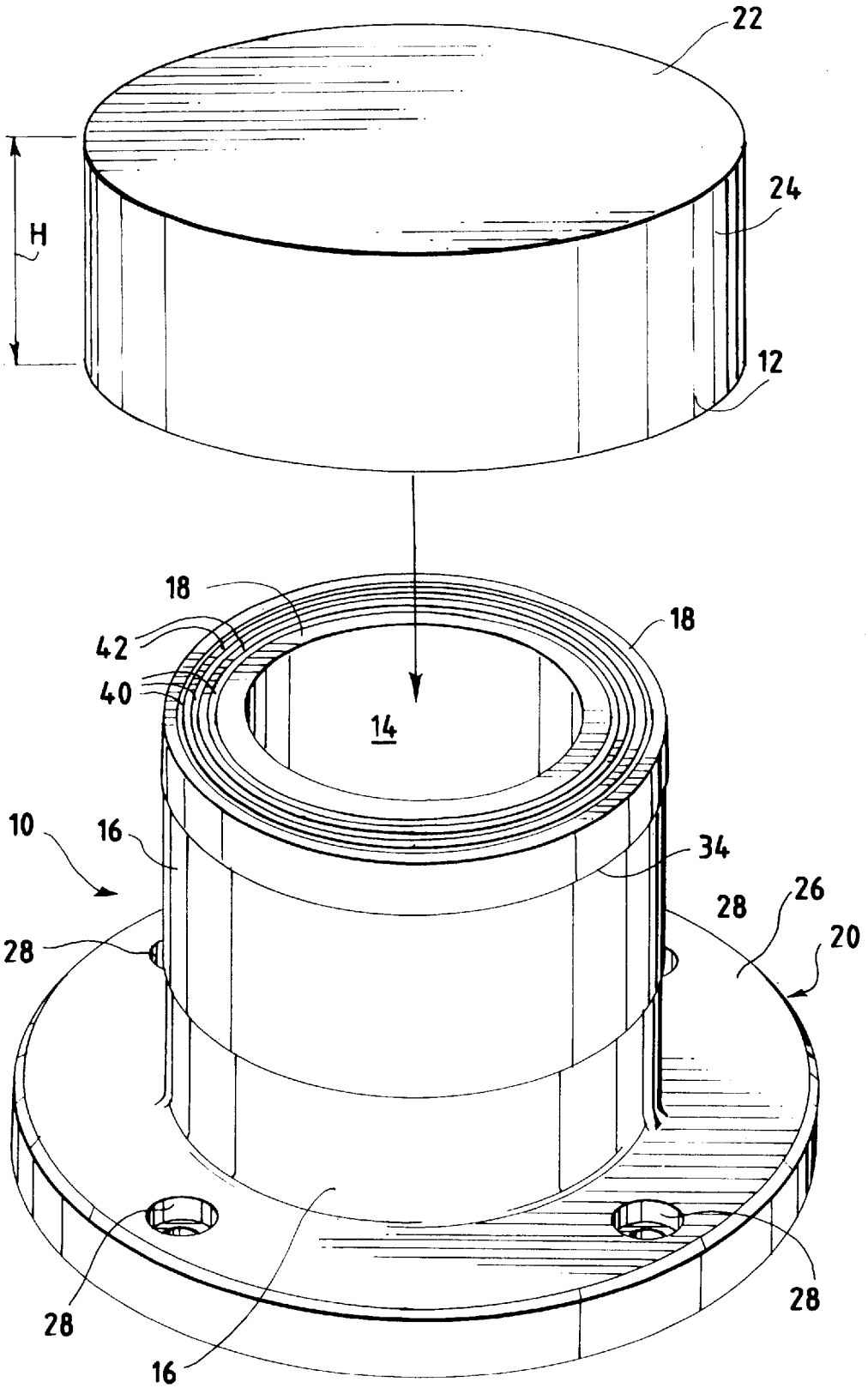
FIG. 1 is a perspective view of a cup and a redraw sleeve according to a preferred embodiment of the invention.
Figure 2:
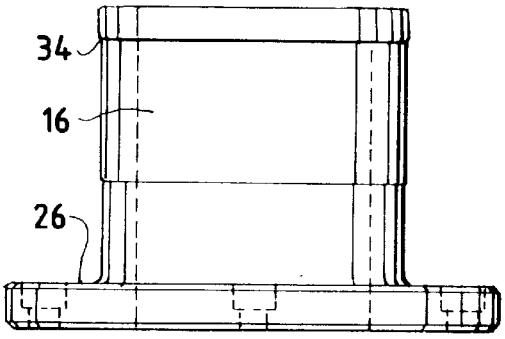
FIG. 2 is an elevational view of the redraw sleeve of FIG. 1.

Referring now to FIGS. 1–5, a redraw sleeve 10 for use with a cup 12 in a body maker or can forming station is shown in a perspective view. The redraw sleeve 10 comprises a cylindrical body having an open interior 14 for receiving the redraw punch, a cylindrical wall 16, a peripheral end wall or face 18, and an opposite end portion indicated generally at 20. The opposite end 20 of the redraw sleeve has a peripheral flange 26 with mounting holes 28 for mounting the redraw sleeve to known and conventional apparatus in the body maker.

A cup 12 to be drawn and ironed into a can in the body maker is also shown in FIG. 1. The cup has a generally circular closed end 22 and a cylindrical sidewall 24 of height H. The cup 12 is positioned over the end of the redraw sleeve 10 as indicated by the arrow when it is inserted into the body maker. The diameter of the end wall 22 of the cup is slightly larger than the diameter of the end 18 of the redraw sleeve, with the difference in diameter somewhat exaggerated in FIG. 1. The open interior 14 of the redraw sleeve receives a punch (not shown) used for forming the cup into a can body. Additionally, the peripheral rim of the end wall of the cup 22 and the peripheral end wall 18 of the redraw sleeve abut a redraw die (not shown) in a known, conventional manner. These details are not considered a part of the present invention. The reader is directed to the patents cited in the Background of the Invention for representative embodiments in which the invention can be used. One of the advantages of the inventive redraw sleeve 10 is that it is compatible with conventional prior art body making apparatus and does not require any additional modifications to the body maker. Rather, the redraw sleeve can be modified to have the novel features described herein and simply replaced back into the body maker.

Figure 5:
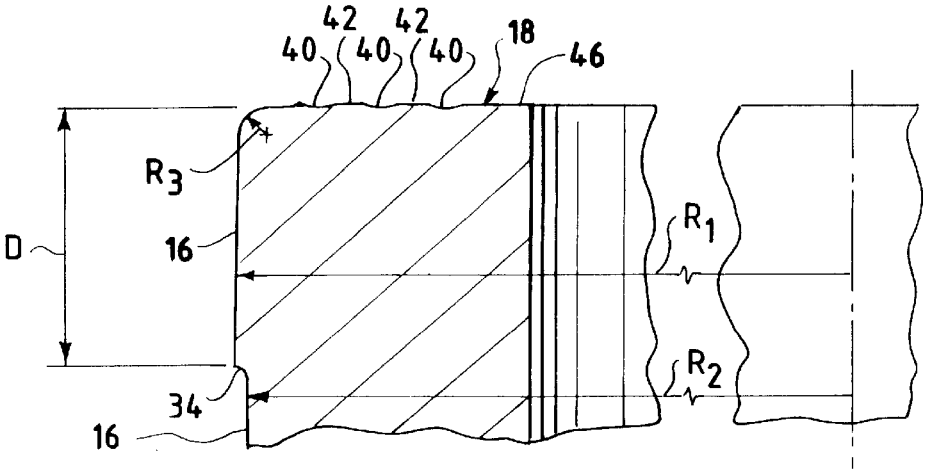
FIG. 5 is an enlarged, fragmentary sectional view of the upper rim and peripheral edge of the redraw sleeve of FIG. 1, illustrating the groove and reduced radius features of the invention.
Figure 6:
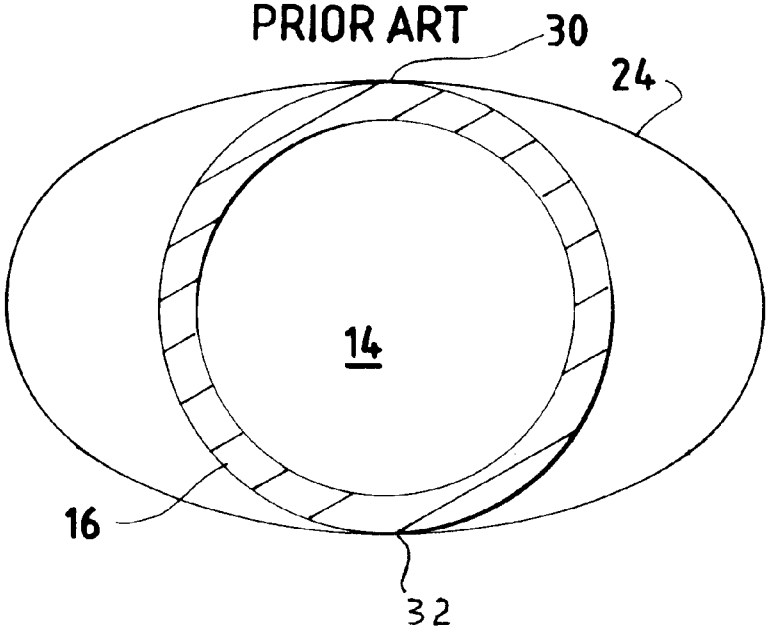
FIG. 6 PRIOR ART
FIG. 6 is an illustration of how the side wall of a cup can become distorted from a spherical shape to an ovoid shape and pinch a prior art redraw sleeve at opposite sides thereof, with the ovoid distortion shown somewhat exaggerated in FIG. 6 in order to illustrate the phenomenon.

As noted earlier, the side wall 24 of the cup 12 has a tendency to flex in an orientation with the grain of the cup material and assume an ovoid shape when it is positioned over the end of the redraw die. This ovoid shape, shown greatly exaggerated in FIG. 6, results in a pinching effect between the cup and the redraw sleeve at points 30 and 32 on opposite sides of the cylindrical wall 16 of a prior art redraw die. This pinching can lead to formation of wrinkles when the cup is redrawn and ironed. To prevent this, we have provided an undercut feature 34 in the cylindrical wall 16 of the redraw sleeve. The undercut feature 34 is located in the working portion of the redraw sleeve 10, that is, proximate to the peripheral end wall 18 and extending around the periphery of the cylindrical wall 16. As best shown in FIG. 5, the undercut feature is such that the radius R1 of the cylindrical wall 16 between the undercut feature and the peripheral end wall is greater than the radius R2 of cylindrical wall 16 in the portion between the undercut feature 34 and the opposite end.

Figure 7:
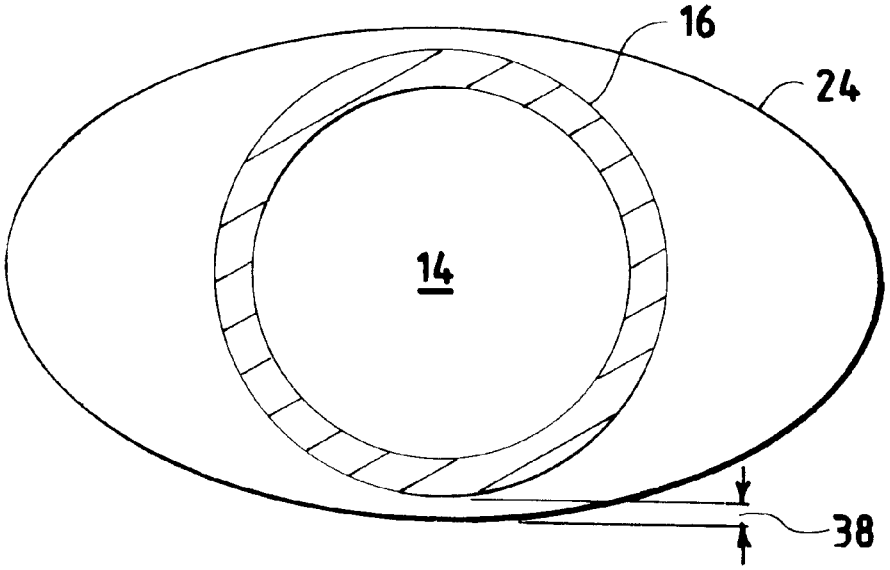
FIG. 7 is an illustration of how the undercut sidewall of the inventive redraw sleeve prevents the pinching shown in FIG. 6 from occurring.

In particular, the undercut feature 34 is located on the cylindrical wall at a distance D (FIG. 5) from the peripheral end wall 18, where D is less than the height H of the cup side wall. Referring to FIG. 7, the reduced radius R2 of the cylindrical wall 16 below the undercut feature provides a circular gap 38 between the walls of the cup and the wall 16 of the redraw sleeve. The gap 38 permits the side wall 24 of the cup 12 to flex in any random direction to form an ovoid cross-sectional shape, without substantial binding between the side wall 24 of the cup and the cylindrical wall 16 of the redraw sleeve during drawing and ironing of the cup. FIG.

7 shows the cup and redraw sleeve in a cross section, showing the gap 38 between the cylindrical wall 16 of the redraw sleeve and the cup sidewall 24.

In the illustrated embodiment, the radius R2 is less than radius R1 by at least 0.010 inches and preferably 0.020 inches, giving a circumferential gap of at least 0.040 inches between the cylindrical wall 16 below the undercut feature 34 and the side wall 24 of the cup 12.

As noted above, the undercut feature 34 is formed such that the distance D between the undercut 34 and the surface of the peripheral end wall 18 is less than the height H of the cup. In the illustrated embodiment, the undercut feature is positioned within one half inch of the peripheral end wall, with a 0.375 inch distance in the illustrated twelve ounce aluminum beverage can embodiment.

To the inventors' knowledge, prior art redraw sleeves did not have such undercut features in the working area of the redraw sleeve, as the redraw sleeves were either perfectly cylindrical or had a slight taper wherein the radius of the redraw die increased with increasing distance away from the peripheral end face. The undercut feature shown in the lower portion of the outer redraw sleeve 74 in FIGS. 5-6 of the Saunders patent, U.S. Pat. No. 4,414,836, is not positioned in the working area of the redraw sleeve and would not contribute to the formation of a gap between the cup and the redraw sleeve and consequent prevention of binding between the can and the redraw sleeve.

To further prevent the formation of wrinkles in the can, the peripheral end wall or face 18 of the redraw sleeve 10 is given features to reduce the surface area thereof. In the illustrated embodiment, the face 18 includes at least one groove 40 and a concentric ridge 42 extending substantially continuously around the peripheral end wall 18. Although the preferred embodiment is a groove that extends substantially continuously around the face, the invention may also be embodied in a face that has alternately grooved and not grooved portion (e.g., a set of discontinuous arcuate segments in the face 18) to produce the result of a reduced surface area and reduce the contact area of the metal cup being redrawn.

Figure 3:
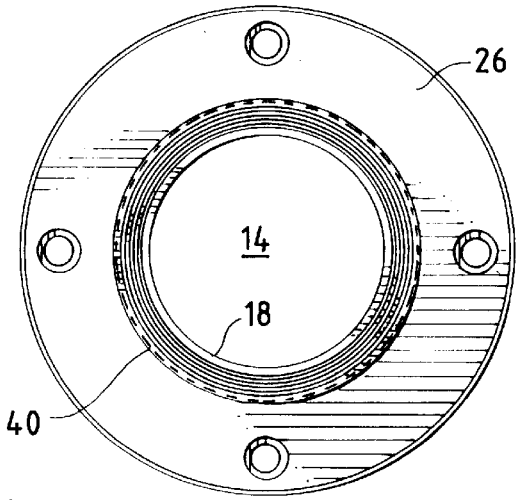
FIG. 3 is a top plan view of the redraw sleeve of FIG. 1.
Figure 4:
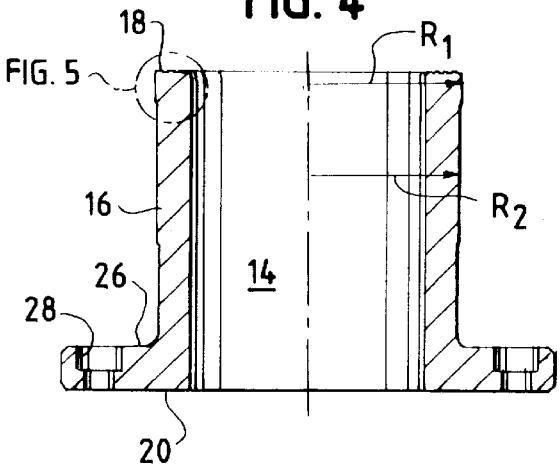
FIG. 4 is a cross-sectional view of the redraw sleeve of FIG. 1.

The preferred multiple concentric and continuous groove embodiment is best shown in the top view of the redraw sleeve shown in FIG. 3, and in the detailed view of the upper comer 44 and end wall 18 of FIG. 5. In the preferred embodiment, three such grooves 40 are provided extending continuously and completely around the surface of the peripheral end wall or face. The ridges 42 separating the grooves are flush with the medial surface 46 of the peripheral end wall 18, hence the ridges 42 do not protrude above the surface 46. The grooves 40 are preferably on the order of 0.003 to 0.008 inches, and more preferably 0.004 inches, in depth and separated from each other (as measured from the point of maximum depth in the groove) by 0.040 to 0.130 inches depending at least in part by the groove width, and preferably approximately 0.09 inches in the illustrated 12 oz. beverage can embodiment. The groove width is preferably 0.030 to 0.070 inches, and more preferably 0.040 to 0.060 inches, and most preferably 0.050 for the illustrated embodiment. It has been discovered that the groove features also promote the smooth and even flow of metal from the end wall of the cup into the sidewall of the cup during the drawing and ironing process, preventing the occurrence of wrinkles.

Referring in particular now to FIG. 5, the intersection of the cylindrical wall 12 and the peripheral wall or face of the redraw sleeve is shown in detail. A reduction in the radius of curvature R3 of the comer has also been found to improve the flow of metal from the end wall to the side wall of the cup during the drawing and ironing process. Whereas in the prior art a radius of curvature R3 of between 0.065 and 0.070 inches was common for the corner 44, we have discovered that the results are improved by reducing the radius R3 to 0.060 inches or less, for example in the range of 0.050 to 0.60 inches, with 0.055 being a presently preferred embodiment.

As noted above, the undercut side wall feature 34, grooves 40 in face 18 and reduced radius features R3 each contribute to a reduction in wrinkling. In a preferred embodiment, all three features are present in the redraw sleeve, such as shown in FIGS. 1–5. However, one or more of the features may be used alone.

Various modifications from the preferred embodiments may be made to the disclosed embodiment without departure from the spirit of the invention. For example, while the dimensions described herein are preferred for an aluminum beverage can body maker, the application of the invention to other can manufacturing applications may require greater or lesser depth to the grooves, greater or lesser depth in the undercut feature or locating it at a greater distance from the end face, etc. This true scope and spirit of the invention is defined by the appended claims, to be interpreted in light of the foregoing specification.

We claim:

1. A redraw sleeve for use in a can body maker, the redraw sleeve comprising a cylindrical body having an open interior, a cylindrical wall, and a working area comprising a peripheral end wall for receiving thereover a cup having a side wall of height H to be drawn and ironed into a can in said can body maker, an upper portion of said side wall and an opposite end, the improvement comprising:

said cylindrical wall of said redraw sleeve comprising an undercut feature located in close proximity to said peripheral end wall in said working area of said redraw sleeve such that said undercut feature is at a distance D substantially less then the height H of said cup, said undercut feature extending around the periphery of said cylindrical wall, wherein the radius R1 of said cylindrical wall between said undercut feature and said peripheral end wall is greater than the radius R2 of said cylindrical wall between said undercut feature and said opposite end, and wherein said undercut feature is located on said cylindrical wall between said peripheral end wall and said distance H from said peripheral end wall at said distance D in a manner such that the reduced radius R2 of said cylindrical wall of said redraw sleeve below said undercut feature provides a gap in which said upper portion of said side wall of said cup flexes to form an ovoid shape without substantial binding between said side wall of said cup and said cylindrical wall of said redraw sleeve during drawing and ironing of said cup.

2. The improvement of claim 1, wherein said peripheral end wall of said redraw sleeve comprises a groove formed in said peripheral end wall.

3. The improvement of claim 2, wherein said peripheral end wall comprises a plurality of grooves and concentric ridges separating said grooves from one another extending substantially continuously around said peripheral end wall.

4. The improvement of claim 1, wherein cylindrical wall comprises a peripheral surface and said peripheral end wall intersects said peripheral surface of said cylindrical at a corner, and wherein said corner has a radius of curvature less than or equal to about 0.060 inches.

5. The improvement of claim 4, wherein said radius of curvature is between 0.050 and 0.060 inches.

6. The improvement of claim 1, wherein said radius R2 is less than said radius R1 by at least 0.020 inches.

7. The improvement of claim 1, wherein said undercut feature is positioned within one half inch of said peripheral end wall.

8. A redraw sleeve for use in a can body maker, the redraw sleeve comprising a cylindrical body having an open interior, a cylindrical wall, a peripheral end wall for receiving thereover a cup having a side wall of height H to be drawn and ironed into a can in said can body maker, and an opposite end, the improvement comprising:

said peripheral end wall of said redraw sleeve comprises at least one groove formed in said peripheral end wall.

9. The improvement of claim 8, wherein said peripheral end wall comprises a plurality of grooves and concentric ridges separating said grooves extending substantially continuously around said peripheral end wall.

10. The improvement of claim 8, wherein cylindrical wall comprises a peripheral surface and said peripheral end wall intersects said peripheral surface of said cylindrical at a comer, and wherein said corner has a radius of curvature less than or equal to about 0.060 inches.

11. The improvement of claim 10, wherein said radius of curvature is between 0.050 and 0.060 inches.

12. The improvement of claim 8, wherein said groove is at least 0.004 inches in depth.

13. The improvement of claim 8, wherein said at least one groove comprises a plurality of discontinuous groves.

14. The improvement of claim 8, wherein said at least one groove comprises a plurality of concentric circular grooves.

15. The improvement of claim 14, wherein said plurality of concentric circular grooves have a width of between 0.030 and 0.070 inches and are separated from each other by a distance of between 0.040 and 0.130 inches.

16. A redraw sleeve for use in a can body maker, the redraw sleeve comprising a cylindrical body having an open interior, a cylindrical wall, and a working area comprising a peripheral end wall for receiving thereover a cup having a side wall of height H to be drawn and ironed into a can in said can body maker, an upper portion of said side wall and an opposite end, the improvement comprising:

said cylindrical wall of said redraw sleeve comprising an undercut feature located in close proximity to said peripheral end wall in said working area of said redraw sleeve such that said undercut feature is at a distance D substantially less then the height H of said cup, said undercut feature extending around the periphery of said cylindrical wall, wherein the radius R1 of said cylindrical wall between said undercut feature and said peripheral end wall is greater than the radius R2 of said cylindrical wall between said undercut feature and said opposite end;

wherein said undercut feature is located on said cylindrical wall between said peripheral end wall and said distance H from said peripheral end wall, the reduced radius R2 of said cylindrical wall of said redraw sleeve below said undercut feature providing a gap in which said upper portion of said side wall of said cup flexes to form an ovoid shape without substantial binding between said side wall of said cup and said cylindrical wall of said redraw sleeve during drawing and ironing of said cup;

said peripheral end wall of said redraw sleeve comprises a plurality of grooves and a concentric ridges, said grooves and concentric ridges extending substantially continuously around said peripheral end wall; and where in said cylindrical wall comprises a peripheral surface and said peripheral end wall intersects said peripheral surface of said cylindrical at a corner, and wherein said comer has a radius of curvature less than or equal to about 0.060 inches.

* * * * *